US009048569B2

(12) United States Patent
Chen

(10) Patent No.: US 9,048,569 B2
(45) Date of Patent: Jun. 2, 2015

(54) WIRE-TO-BOARD CONNECTOR ASSEMBLY AND BOARD-END CONNECTOR THEREOF

(71) Applicant: WISTRON CORP., New Taipei (TW)

(72) Inventor: Hung Sheng Chen, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 14/157,565

(22) Filed: Jan. 17, 2014

(65) Prior Publication Data

US 2015/0044913 A1 Feb. 12, 2015

(30) Foreign Application Priority Data

Aug. 9, 2013 (TW) ..... 102128654 A

(51) Int. Cl.
*H01R 13/627* (2006.01)
*H01R 13/62* (2006.01)
*H01R 13/11* (2006.01)

(52) U.S. Cl.
CPC ..... *H01R 13/62* (2013.01); *H01R 13/6273* (2013.01); *H01R 13/113* (2013.01)

(58) Field of Classification Search
CPC .. H01R 13/518; H01R 13/62; H01R 13/6273; H01R 13/113
See application file for complete search history.

(56) References Cited

U.S. PATENT DOCUMENTS

| | | | | |
|---|---|---|---|---|
| 7,261,579 | B2 | 8/2007 | Ku et al. | |
| 7,303,444 | B2 * | 12/2007 | Denpouya | 439/660 |
| 7,354,313 | B2 * | 4/2008 | Kumazawa et al. | 439/638 |
| 7,828,585 | B2 * | 11/2010 | Kurimoto | 439/682 |
| 7,927,122 | B2 * | 4/2011 | Yamaji et al. | 439/342 |
| 8,052,457 | B2 * | 11/2011 | Miyazaki et al. | 439/357 |
| 2006/0094304 | A1 * | 5/2006 | Masaki et al. | 439/850 |
| 2006/0094306 | A1 * | 5/2006 | Masaki et al. | 439/850 |
| 2008/0032526 | A1 * | 2/2008 | Takahashi | 439/81 |
| 2011/0151708 | A1 * | 6/2011 | Kaneko et al. | 439/404 |
| 2012/0077365 | A1 * | 3/2012 | Kobayashi et al. | 439/345 |
| 2013/0143444 | A1 * | 6/2013 | Chen | 439/626 |

FOREIGN PATENT DOCUMENTS

| | | |
|---|---|---|
| TW | M400135 U1 | 3/2011 |
| TW | I368361 | 7/2012 |
| TW | M436264 | 8/2012 |
| TW | M436264 U1 | 8/2012 |

OTHER PUBLICATIONS

Taiwan Patent Office, Office action issued on Jan. 27, 2015.

* cited by examiner

*Primary Examiner* — Briggitte R Hammond
(74) *Attorney, Agent, or Firm* — Li & Cai Intellectual Property (USA) Office

(57) ABSTRACT

The instant disclosure relates to a wire-to-board connector assembly including a board-end connector and a wire-end connector. The board-end connector has a first insulative housing, a pair of restricting components and a pair of elastic elements. The first insulative housing has a transverse portion and a pair of side walls. The pair of restricting components is movably assembled to the pair of side walls, and has a suppressing portion, respectively. The wire-end connector has a second insulative housing and a plurality of wires. Two sides of the second housing have a wing portion and a blocking bump located above the wing portion, respectively. When the wire-end connector is assembled to the board-end connector, the wing portion is located under the suppressing portion, and the blocking bump is disposed before the front end of the suppressing portion so as to limit the displacement of the wire-end connector.

16 Claims, 9 Drawing Sheets

WIRE-TO-BOARD CONNECTOR ASSEMBLY AND BOARD-END CONNECTOR THEREOF

BACKGROUND OF THE INVENTION

1. Field of the Invention

The instant disclosure relates to a wire-to-board connector assembly, and more particularly to a connector used to connect one or more insulative wires to a component, such as a printed circuit board (PCB), including a wire-end connector connected to a wire, and a board-end connector fixed on a circuit board.

2. Description of Related Art

In communications equipment for transferring large volumes of information, wire-to-board connector is one kind of connector device widely used in electronic communication field, which includes a wire-end connector and a board-end connector. The wire-end connector is a wire-attached plug connector attached with an end of coaxial wires arranged in parallel into a flat shape. The board-end connector is mounted on a substrate, such as a circuit board, for processing signals transiting the wires. The wire-end connector is usually plugged into the board-end connector along a plane in a horizontal manner (or called as right-angle type) or in an erective manner (or called as vertical type).

Concerning the connector of right-angle type, the wire-end connector is plugged in the board-end connector along a direction parallel to the circuit board (or called as horizontal direction) and is pulled out along the horizontal direction. This type needs to remain a redundant 10 mm-15 mm length of the wire and an operating space for user bent the wire during plugging and pulling, especially pulling action, which are its disadvantages. Such additional length of wire seriously affects the layout of portable electronic product, which occupies the space of system.

Concerning the connector of the vertical type, the wire-end connector is plugged in and pulled out from the board-end connector along a direction perpendicular to the circuit board. This type does not need to provide additional length of wires, so as to save length of wires and operating space. However, during the drop test or under external force, since the design height of the wire-to-board connector assembly is limited by specification, the wire-end connector is easily to escape from the board-end connector. Therefore, the conventional wire-to-board connector assembly of the vertical type usually has the conditions of bad connection or short.

SUMMARY OF THE INVENTION

The object of the instant disclosure is to provide a wire-to-board connector assembly, wherein the wire-end connector is assembled in the board-end connector along a vertical direction, and is pulled out of the board-end connector along a horizontal direction, so as to solve a problem of disassembling easily of a horizontal-assembling wire-end connector, without remaining additional length of wires.

According to one embodiment of the present invention, the wire-to-board connector assembly includes a board-end connector and a wire-end connector. The board-end connector includes a first insulated housing, a pair of restricting components and a pair of elastic elements. The first insulated housing includes a transverse portion, and a pair of side walls a pair of side walls arranged at two sides of the transverse portion. The pair of restricting components is movably assembled to the pair of side walls respectively along a direction of perpendicular to the side walls. Each of the restricting components has a suppressing portion extended inward from an inner side thereof. A restraining recess is formed between a bottom side of the suppressing portion and the first insulated housing. A blocking space is formed between a front of the suppressing portion and the transverse portion. The pair of elastic elements is respectively disposed between the pair of restricting components and the pair of side walls correspondingly. The elastic element pushes in a normal manner pushing the restricting components inwardly at a locking location away from the side walls.

The wire-end connector has a second insulative housing and a plurality of wires. The second insulative housing has two sides, and each side of the second insulative housing having a wing portion and a blocking bump. The blocking bump is arranged above the wing portion. The wires have one end extended into the second insulative housing.

When the wire-end connector is assembled to the board-end connector, the wing portion of the second insulative housing located in the restraining recess, and the suppressing portion arranged above the wing portion to block the wing portion from moving along a vertical direction. The blocking bump is located in the blocking space, and the front end of the suppressing portion blocks the blocking bump from moving along a horizontal direction.

The instant disclosure further provides a board-end connector, including a first insulated housing, a plurality of first terminals, a pair of restricting components and a pair of elastic elements. The first insulated housing has a transverse portion, and a pair of restricting components and a pair of elastic elements. The first insulated housing includes a transverse portion, and a pair of side walls a pair of side walls arranged at two sides of the transverse portion. The pair of restricting components is movably assembled to the pair of side walls respectively along a direction of perpendicular to the side walls. Each of the restricting components has a suppressing portion extended inward from an inner side thereof. A restraining recess is formed between a bottom side of the suppressing portion and the first insulated housing. A blocking space is formed between a front of the suppressing portion and the transverse portion. The pair of elastic elements is respectively disposed between the pair of restricting components and the pair of side walls correspondingly. The elastic element pushes in a normal manner pushing the restricting components inwardly at a locking location away from the side walls.

The instant disclosure has the following advantages. The wire-end connector is inserted in the board-end connector along a vertical direction (perpendicular to the circuit board), and is pulled out from the board-end connector along a horizontal direction (parallel to the circuit board). The displacements in vertical and horizontal directions of the wire-end connector are limited, so that it has advantages of easily-to-assembly, stable combination and hard-to-escape . . . etc.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE EMBODIMENTS

Figure 1:
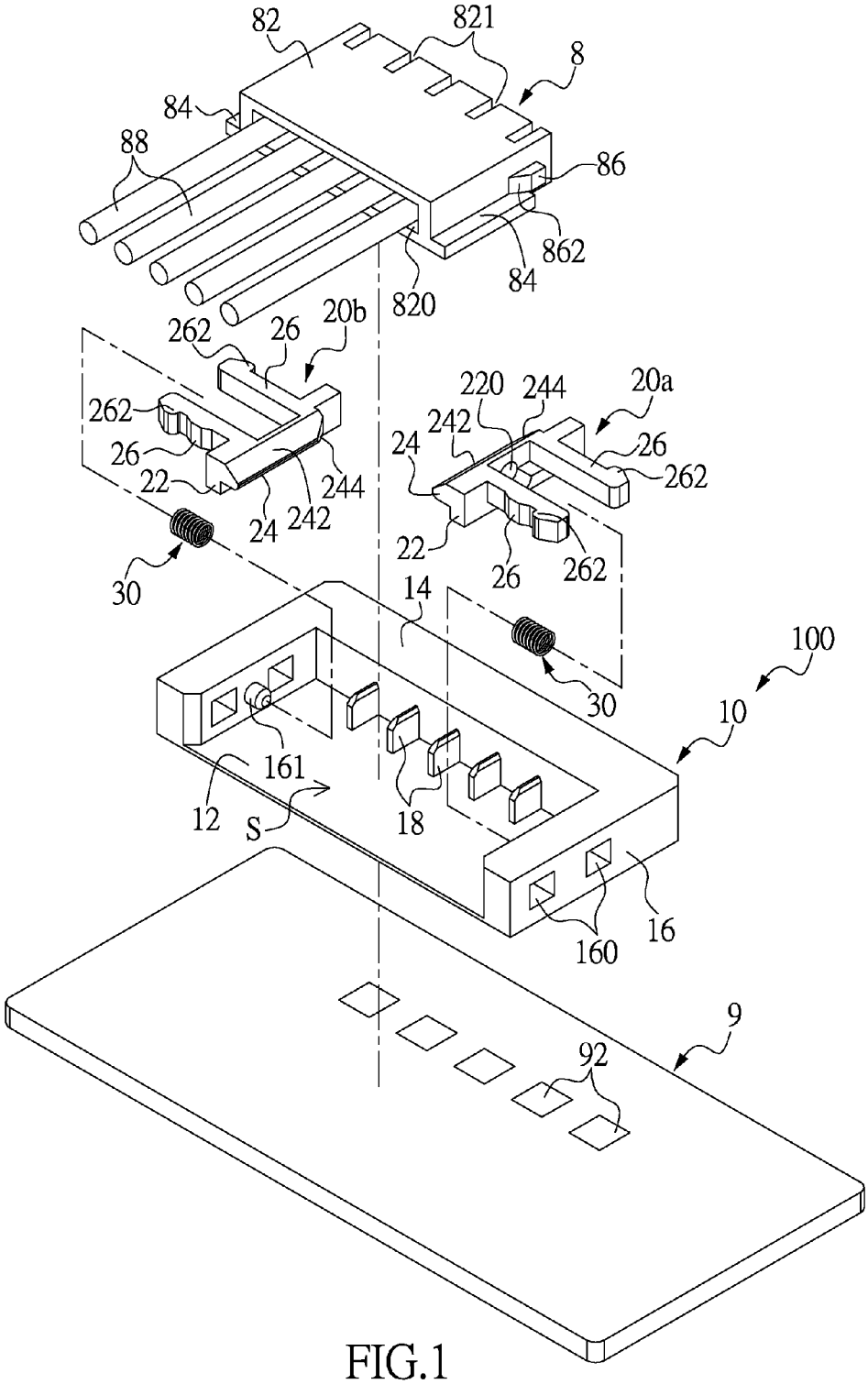
FIG. 1 is a perspective exploded view showing a wire-to-board connector assembly of the instant disclosure.
Figure 2:
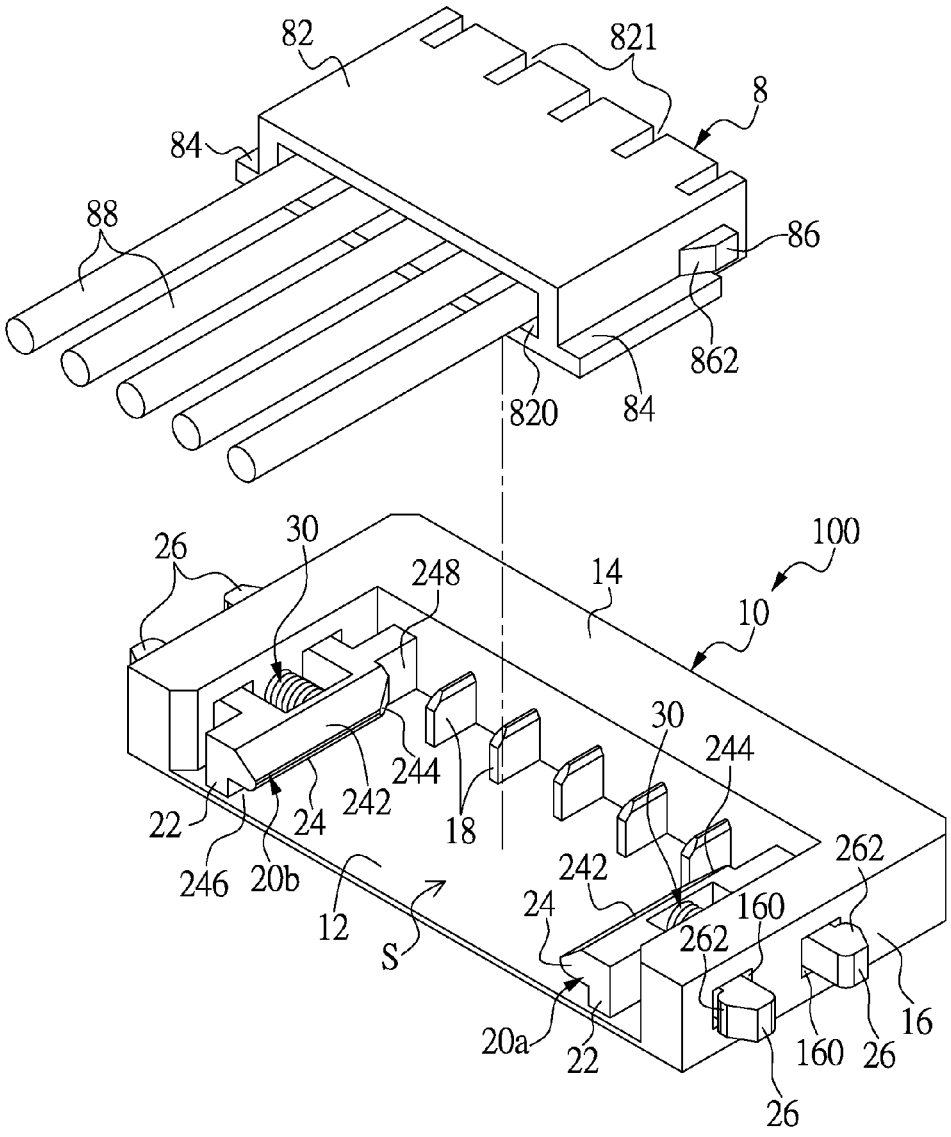
FIG. 2 is an assembled view of the wire-to-board connector assembly of the instant disclosure.

Please refer to FIGS. 1 and 2, which are a perspective exploded and assembled views of a wire-to-board connector assembly according to the instant disclosure. The wire-to-board connector assembly includes a board-end connector 100 and a wire-end connector 8. The board-end connector 100 is fixed on a circuit board 9, and has a first insulated housing 10, a pair of restricting components 20*a*, 20*b*, and a pair of elastic elements 30. The wire-end connector 8 has a second insulative housing 82, and a plurality of wires 88. The circuit board 9 has a plurality of welding pads 92.

The following description defines a vertical direction as a direction of perpendicular to the circuit board 9, and a horizontal direction as a direction of parallel to the circuit board 9. However, such definitions are just used to comprehend the instant disclosure conveniently, not intend to limit the instant invention.

As regards the first insulated housing 10 of the board-end connector 100, it includes a bottom board 12, a transverse portion 14, and a pair of side walls 16 arranged at two sides of the transverse portion 14, which define an inserting space S cooperatively. The transverse portion 14 is connected to a front edge of the bottom board 12. The pair of side walls 16 is connected to two sides of the bottom board 12 respectively. The transverse portion 14 and the side walls 16 have an inner side and an outer side respectively, which are substantially vertical planes. The board-end connector 100 further has a plurality of first terminals 18 fixed to the transverse portion 14 of the first insulated housing 10. The first terminals 18 are welded to the welding pads 92 correspondingly.

The pair of restricting components 20*a*, 20*b* is movably assembled to the pair of side walls 16 respectively along a direction of perpendicular to that of the side walls 16, that is along the normal line of the side walls 16. Each of the restricting components (20*a*, 20*b*) includes a base portion 22, a suppressing portion 24 extended inward, and a pair of arm portions 26 extended from one end of the base portion 22. The suppressing portion 24 is extended from a top edge of the base portion 22 opposite to the pair of arm portions 26. As shown in FIG. 2, a restraining recess 246 is formed between a bottom surface of the suppressing portion 24 and the first insulated housing 10. A blocking space 248 is formed between a front end of the suppressing portion 24 and the transverse portion 14. Each side wall 16 of the first insulated housing 10 is formed with a pair of through holes 160. The pair of arm portions 26 is passed through the pair of through holes 160 correspondingly. Each of the arm portions 26 has a free end formed with a hook 262 to hook the outer side of the side walls 16.

In this embodiment, the pair of elastic elements 30 is arranged respectively between the pair of restricting components 20*a*, 20*b* and the pair of side walls 16. The elastic elements 30 normally push the restricting components 20*a*, 20*b* inwardly to a locking location away from the side walls 16.

Refer to FIG. 1, the base portion 22 of the restricting components (20*a*, 20*b*) is formed with a receiving hole 220 transversely. The elastic element 30 of this embodiment is a compression spring and is received in the receiving hole 220. Each of the side walls 16 has a guiding post 161 extended inwardly from an inner side thereof. The guiding post 161 is located between the pair of through holes 160. The elastic element 30 is arranged on the guiding post 161. However, the elastic element of this instant disclosure is not limited to this and may be a leaf spring, for example.

Refer to FIG. 2, in this embodiment, the length of the suppressing portion 24 is shorter than that of the base portion 22, and one end of the suppressing portion 24 is aligned with one end of the base portion 22. The suppressing portion 24 has an oblique surface 242 formed on a top surface thereof. Besides, the other end of the suppressing portion 24 has an oblique angle 244, and the blocking space 248 is formed between the suppressing portion 24 and the base portion 22. The wire-end connector 8 has a blocking bump 86 against the oblique angle 244 of the suppressing portion 24.

In regard to the wire-end connector 8, the second insulative housing 82 is formed with a wire receiving portion 820 facing reward for receiving one end of the wires 88. Each side of the second insulative housing 82 has a wing portion 84 and a blocking bump 86. The blocking bump 86 is arranged above the wing portion 84. The wire-end connector 8 further has a plurality of second terminals (not shown) disposed in the terminals grooves 821 of the second insulative housing 82 corresponding to the first terminals 18.

Refer to FIG. 2, which shows a normal condition of the board-end connector 100 according to the instant disclosure, wherein the restricting components 20*a*, 20*b* are pushed by the elastic element 30 at a locking location away from the side walls 16. The wire-end connector 8 is assembled to an inserting space S of the board-end connector 100 along a vertical direction. During assembling, the wing portion 84 of the wire-end connector 8 firstly presses the oblique surface 242 of the suppressing portion 24, so that the restricting components (20*a*, 20*b*) are pushed and moved outwardly.

Figure 3:
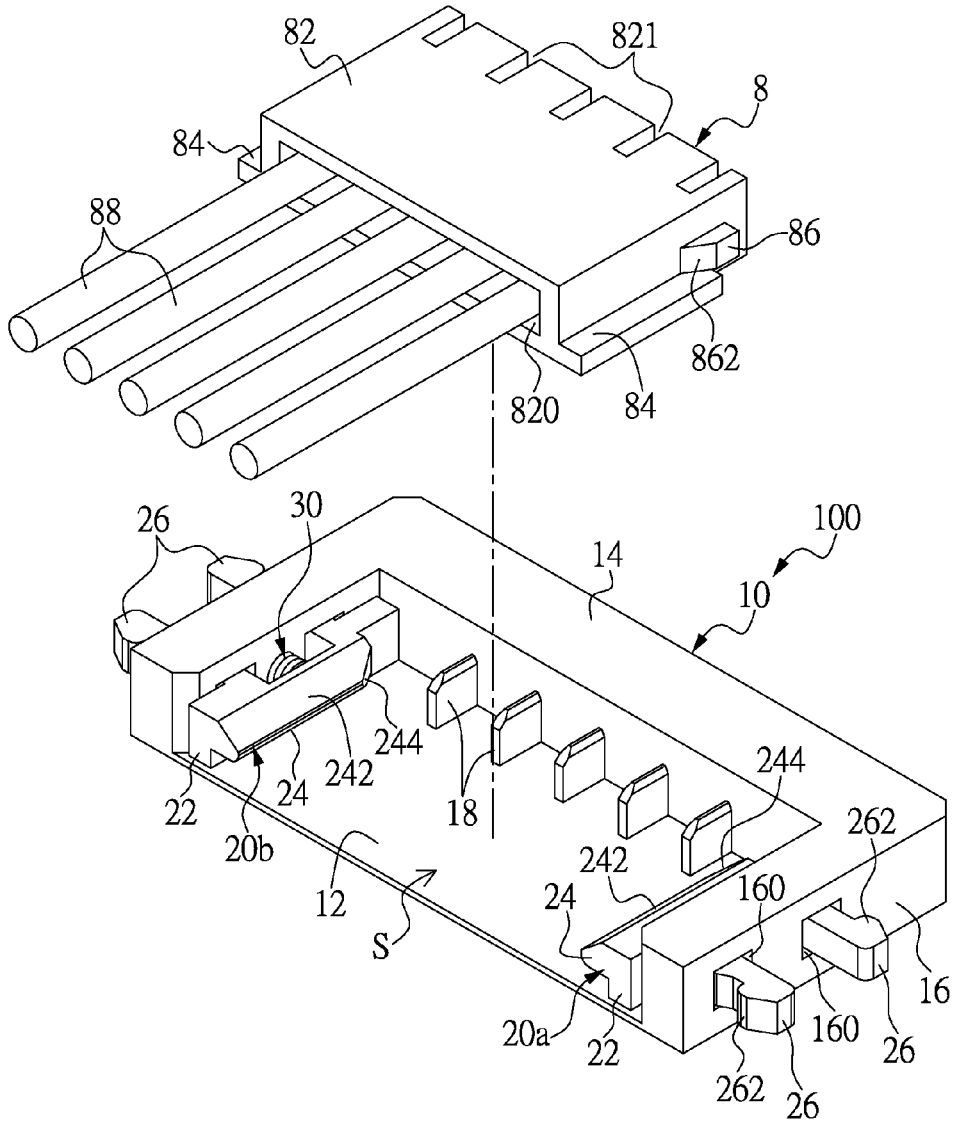
FIG. 3 is a perspective view of the wire-to-board connector assembly during assembling according to the instant disclosure.

Refer to FIG. 3, which shows a perspective view of the restricting components (20*a*, 20*b*) have been pushed outward. The base portion 22 is substantially against the side walls 16, and the elastic element 30 is compressed so as to reserve an elastic force. When the wire-end connector 8 is pushed to the bottom board 12 of the board-end connector 100, the restricting components (20*a*, 20*b*) will move inward to the locking location by the elastic force of the elastic element 30, and clamp the wing portion 84 of the wire-end connector 8, as shown in FIG. 4.

Figure 4:
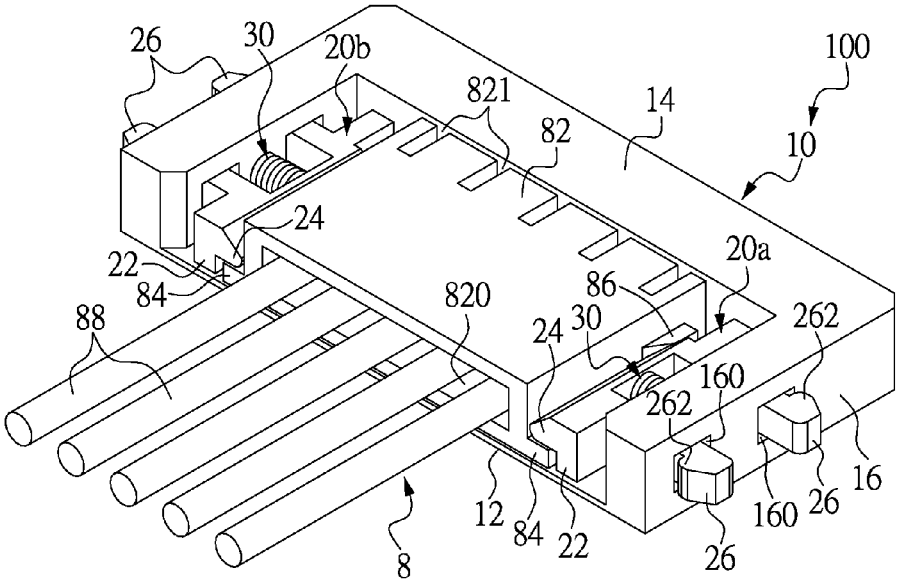
FIG. 4 is a perspective view of the wire-to-board connector assembly after assembled of the instant disclosure.
Figure 4A:
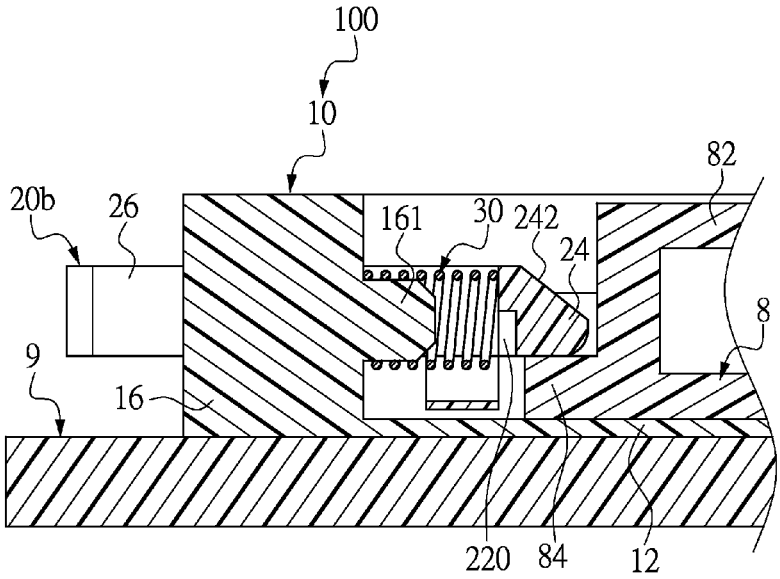
FIG. 4A is a cross-sectional view of the wire-to-board connector assembly along a vertical plan of the instant disclosure.
Figure 4B:
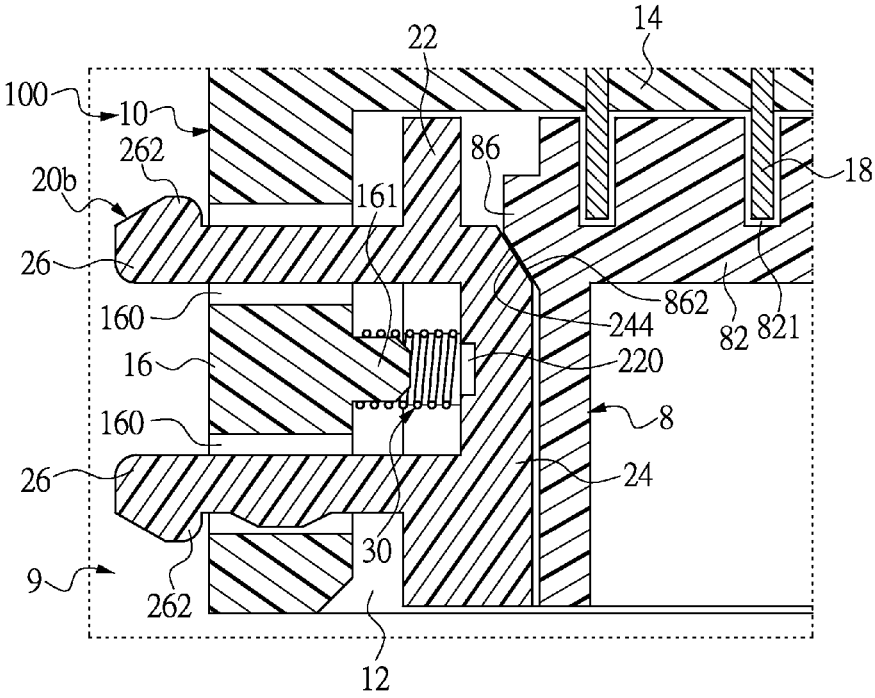
FIG. 4B is a cross-sectional view of the wire-to-board connector assembly along a horizontal plan of the instant disclosure.

Refer to FIG. 4 and FIG. 4A, after the wire-end connector 8 is assembled to the board-end connector 100, the wing portions 84 of the second insulative housing 82 are located in the restraining recess 246 (as labeled in FIG. 2), and the suppressing portion 24 are located above the wing portion 84 to block the wing portion 84 from moving along the vertical direction (i.e. upwardly). The blocking bump 86 is located in the blocking space 248 (as labeled in FIG. 2). As shown in FIG. 4B, a front end of the suppressing portion 24 blocks the blocking bump 86 from moving along the horizontal direction, i.e. away from the transverse portion 14. The wire-end connector 8 is therefore firmly assembled with the board-end connector 100, and the problem of easy-escaping of prior art can be solved.

Refer to FIG. 4 and FIG. 4B. When user wants to pull the wire-end connector 8 out, different from the conventional vertical-type connector, the wire-end connector 8 of the instant disclosure is pulled along the horizontal direction. By exerting a proper pulling force, the oblique surface 862 of the blocking bump 86 (as labeled in FIG. 2) pushes the oblique angle 244 at the front end of the suppressing portion 24, and then pushes the restricting components (20*a*, 20*b*) outwardly. By this arrangement, the wires 88 of this embodiment are not needed to remain an additional length for operating the insertion action of the wire-end connector 8, and the wires 88 will restrict the outward displacement of the wire-end connector 8.

According to the instant disclosure, the wire-end connector 8 is inserted into the board-end connector 100 in a vertical manner that perpendicular to the circuit board 9, and pulled out from the board-end connector 100 in a horizontal manner that parallel to the circuit board 9. By this arrangement, the displacements along the vertical and horizontal directions of the wire-end connector 8 are limited, so that it has advantages of easy assembly, stable combination and hard-to-escape . . . etc. Comparing with prior art, the instant disclosure does not increase an additional height of the board-end connector 100, but it solve the disadvantage of vertical-type connector that is escaping easily.

Figure 5:
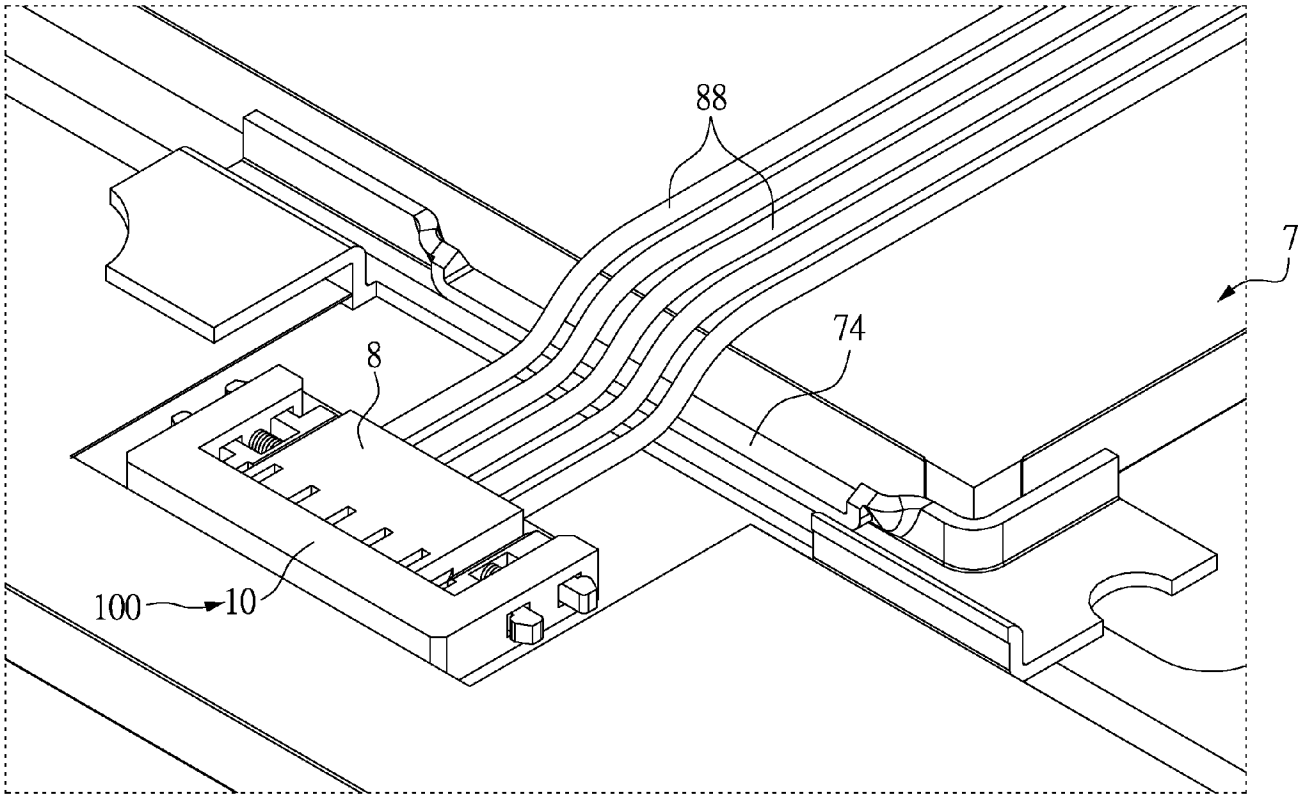
FIG. 5 is a perspective of the wire-to-board connector assembly of the instant disclosure arranged in an electronic product.
Figure 5A:
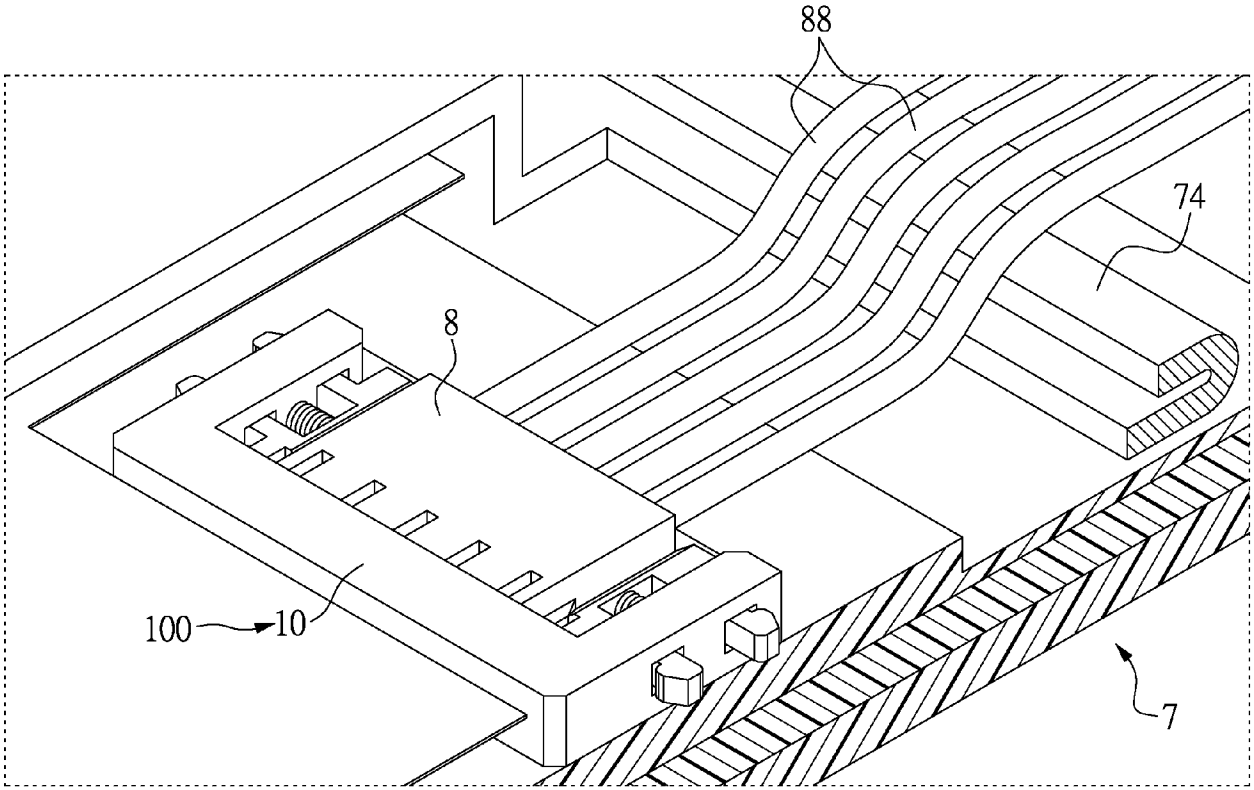
FIG. 5A is a partially enlarged cross-sectional view of FIG. 5.

Refer to FIG. 5 and FIG. 5A. FIG. 5 shows an example of the wire-to-board connector assembly of the instant disclosure installed on the back side of an electronic product 7, and FIG. 5A is an enlarged view of FIG. 5. The instant disclosure is specially adapted to the electronic product 7 having a shielding element 74. FIG. 5 is an example of liquid crystal display, and the wire-to-board connector assembly can be used to transmit data. The back side of the liquid crystal display usually has various elements like the shielding element 74. The shielding element 74 is very close to the board-end connector 100, so that the operable space is very limited. The user is not conveniently to insert the wire-end connector into the board-end connector along a horizontal direction. In the example of FIG. 5, instead of horizontal direction, the instant disclosure provides the wire-end connector 8 which is easily assembled to the board-end connector 100 in a vertical direction among the shielding element 74. Besides, in FIG. 5, the wire-end connector 8 of the instant disclosure is pulled out along a horizontal direction parallel to the electronic product 7. Regarding to the vertical direction, after the wire-end connector 8 is assembled, the board-end connector 100 is locked by the restricting components 20*a*, 20*b* (as shown FIG. 4) and cannot have displacement along the vertical direction. The problems of easily-to-escape and not endurable in drop test of prior art are solved effectively. When this embodiment is assembled, the axial rigidity of the wires 88 also help to limit the wire-end connector 8 from moving outwardly, which is also benefit to enhance the stability of the wire-to-board connector assembly.

Figure 6:
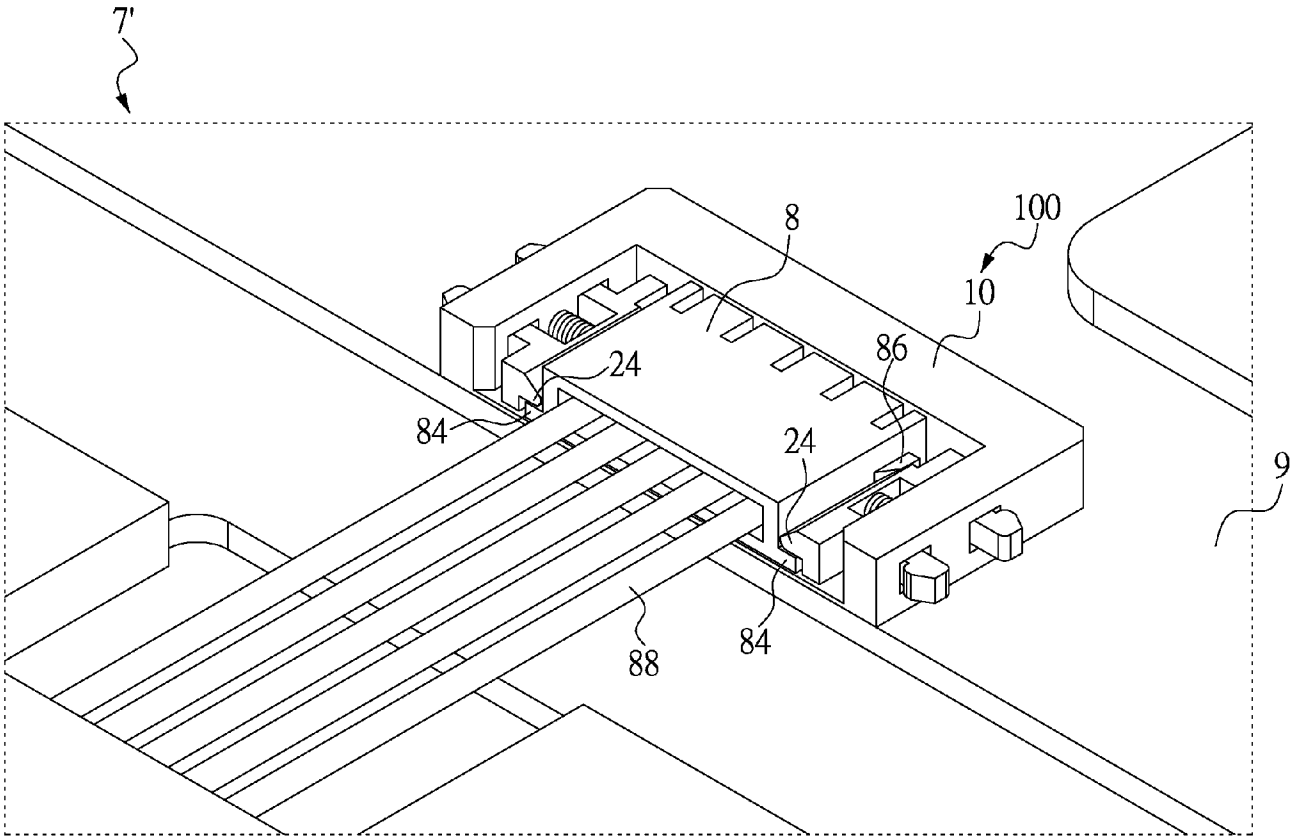
FIG. 6 is perspective view of the wire-to-board connector assembly disposed on a back side of another electronic product.
Figure 6A:
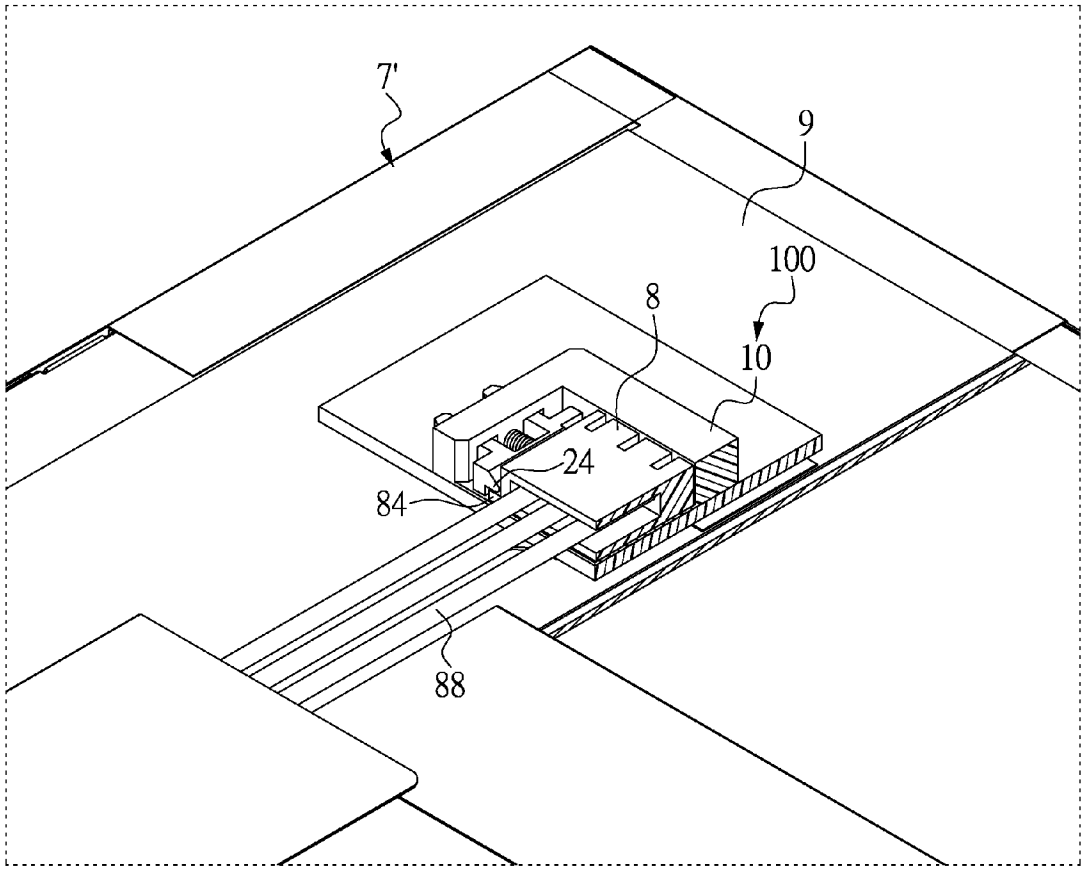
FIG. 6A is a partial cross-sectional view of FIG. 6.

Refer to FIG. 6 and FIG. 6A. FIG. 6 shows another example of the wire-to-board connector assembly of the instant disclosure installed on the back side of an electronic product 7', and FIG. 6A is an enlarged view of FIG. 6. FIG. 6 illustrates the wire-to-board connector assembly of the instant disclosure is installed on the back side of the electronic product 7' for connecting a battery. The wire-end connector 8 is connected to a battery (not shown), and the board-end connector 100 is mounted on the circuit board 9. When the instant disclosure is applied in such kinds of space, the wires 88 of the wire-end connector 8 are not need bent in advance, just need to put from up to down the wire-end connector 8 in the board-end connector 100. The suppressing portion 24 will block the wing portion 84 from moving along the vertical direction, also block the blocking bump 86 from moving along the horizontal direction. Thus, the wire-end connector 8 is well fixed in the board-end connector 100 in the vertical and horizontal directions.

As shown in FIG. 6, the instant disclosure does not need additional length of the wire for user inserting the wire-end connector 8, so that the disadvantage of prior art in regard to remaining additional length is solved. Similar to the above-mentioned example of FIG. 5, since the wire 88 is straightly disposed on the back side of the electronic product 7', the axial rigidity of the wires 88 also help to limit the wire-end connector 8 from moving outwardly after the embodiment is assembled. From another point of view, the dismounting of the wire-end connector 8 is more difficult, so that the wire-end connector 8 is remained and more stably fixed in the board-end connector 100. Thus, an "easy-to-assemble and hard-to-dismount" design according to the instant disclosure is a new anti-mistaking design.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A wire-to-board connector assembly, comprising:

a board-end connector, including:

a first insulated housing, having a transverse portion, and a pair of side walls arranged at two sides of said transverse portion;

a pair of restricting components, movably assembled to the pair of side walls respectively along a direction of perpendicular to said side walls, each of said restricting components having a suppressing portion extended inward from an inner side thereof, wherein a restraining recess is formed between a bottom side of said suppressing portion and said first insulated housing; a blocking space is formed between a front of said suppressing portion and said transverse portion; and a pair of elastic elements, respectively disposed between the pair of restricting components and the pair of side walls correspondingly, said elastic element pushing in a normal manner pushing said restricting components inwardly at a locking location away from said side walls; and a wire-end connector, including:

a second insulative housing, having two sides, and each side of the second insulative housing having a wing portion and a blocking bump, wherein said blocking bump is arranged above said wing portion; and a plurality of wires, having one end extended into said second insulative housing;

whereby, when said wire-end connector is assembled to said board-end connector, said wing portion of said second insulative housing located in said restraining recess, said suppressing portion arranged above said wing portion to block said wing portion from moving along a vertical direction; said blocking bump located in said blocking space, the front end of said suppressing portion blocking said blocking bump from moving along a horizontal direction.

2. The wire-to-board connector assembly of claim 1, wherein the board-end connector further has a plurality of first terminals; said wire-end connector further has a plurality of second terminals fixed in said second insulative housing corresponding to said first terminals.

3. The wire-to-board connector assembly of claim 2, wherein the first insulated housing has a bottom board, said transverse portion is connected to a front edge of said bottom board, said pair of side walls is connected to two sides of said bottom board.

4. The wire-to-board connector assembly of claim 3, wherein each of said restricting components has a base portion, and a pair of arm portions extended from a side of said base portion, wherein said suppressing portion is extended from a top edge of said base portion in a direction away from said pair of arm portions, each side wall of said first insulated housing is formed with a pair of through holes, said pair of arm portions respectively passes through said pair of through holes, each of said arm portions is formed with a hook at an free end thereof to hook an outer side of said side walls respectively.

5. The wire-to-board connector assembly of claim 4, wherein said suppressing portion is shorter than said base portion, said suppressing portion has one end aligned with one end of said base portion, said suppressing portion has an oblique surface formed on a top surface thereof, the other end of said suppressing portion has an oblique angle, wherein said blocking bump of said wire-end connector is against said oblique angle of said suppressing portion.

6. The wire-to-board connector assembly of claim 4, wherein said base portion is formed with a receiving hole, said elastic element is a compression spring, said compression spring is received in said receiving hole.

7. The wire-to-board connector assembly of claim 6, wherein each of said side walls has a guiding post extended inward from an inner side thereof, said guiding post is located between said pair of through holes, said elastic element is put on said guiding post.

8. The wire-to-board connector assembly of claim 1, wherein said first insulated housing includes a bottom board, said transverse portion is connected to a front edge of said bottom board, said pair of side walls connect to two sides of said bottom board.

9. The wire-to-board connector assembly of claim 8, wherein each of said restricting components includes a base portion, and a pair of arm portions extended from one side of said base portion, wherein said suppressing portion is extended from a top edge of said base portion in a direction away from said pair of arm portions, each side wall of said first insulated housing is formed with a pair of through holes, said pair of arm portions respectively passes through said pair of through holes, each of said arm portions is formed with a hook at an free end thereof to hook an outer side of said side walls respectively.

10. The wire-to-board connector assembly of claim 9, wherein said suppressing portion is shorter than said base portion, said suppressing portion has one end aligned with one end of said base portion, said suppressing portion has an oblique surface formed on a top surface thereof, the other end of said suppressing portion has an oblique angle, wherein said blocking bump of said wire-end connector is against said oblique angle of said suppressing portion.

11. The wire-to-board connector assembly of claim 9, wherein said base portion is formed with a receiving hole, said elastic element is a compression spring, said compression spring is received in said receiving hole.

12. The wire-to-board connector assembly of claim 11, wherein each of said side walls has a guiding post extended inward from an inner side thereof, said guiding post is located between said pair of through holes, said elastic element is put on said guiding post.

13. The wire-to-board connector assembly of claim 1, wherein each of said restricting components includes a base portion, and a pair of arm portions extended from one side of said base portion, wherein said suppressing portion is extended from a top edge of said base portion in a direction away from said pair of arm portions, each side wall of said first insulated housing is formed with a pair of through holes, said pair of arm portions respectively passes through said pair of through holes, each of said arm portions is formed with a hook at an free end thereof to hook an outer side of said side walls respectively.

14. The wire-to-board connector assembly of claim 13, wherein said suppressing portion is shorter than said base portion, said suppressing portion has one end aligned with one end of said base portion, said suppressing portion has an oblique surface formed on a top surface thereof, the other end of said suppressing portion has an oblique angle, wherein said blocking bump of said wire-end connector is against said oblique angle of said suppressing portion.

15. The wire-to-board connector assembly of claim 13, wherein said base portion is formed with a receiving hole, said elastic element is a compression spring, said compression spring is received in said receiving hole.

16. The wire-to-board connector assembly of claim 15, wherein each of said side walls has a guiding post extended inward from an inner side thereof, said guiding post is located between said pair of through holes, said elastic element is put on said guiding post.

* * * * *